US006302637B1

(12) United States Patent
Andros

(10) Patent No.: US 6,302,637 B1
(45) Date of Patent: Oct. 16, 2001

(54) HARVEST BIN

(76) Inventor: Matt Andros, P.O. Box 856, Santa Margarita, CA (US) 93453

( * ) Notice: Subject to any disclaimer, the term of this patent is extended or adjusted under 35 U.S.C. 154(b) by 0 days.

(21) Appl. No.: 09/626,501

(22) Filed: Jul. 27, 2000

(51) Int. Cl.[7] ..... B65G 65/23
(52) U.S. Cl. ..... 414/421; 414/422; 414/607
(58) Field of Search ..... 414/607, 421, 414/422

(56) References Cited

U.S. PATENT DOCUMENTS 3,124,265 * 3/1964 Bertels ..... 414/607 X
3,887,091 * 6/1975 Buck ..... 414/344
3,891,106 * 6/1975 Alcanzare ..... 414/422
4,561,822 * 12/1985 Schmook ..... 414/422

FOREIGN PATENT DOCUMENTS

1002903 * 1/1977 (CA) ..... 414/607
2557868 * 7/1985 (FR) ..... 414/607

* cited by examiner

*Primary Examiner*—Steven A. Bratlie
(74) *Attorney, Agent, or Firm*—Donald D. Mon

(57) ABSTRACT

A conventional harvest bin carrying grapes is transported to a winery onboard a flatbed trailer and is emptied by tipping the bin on end so that the grapes tumble over the side of the trailer into a conveyor. The modification of the present invention permits the bins to be emptied into a dump truck at the vineyard by a forklift equipped with a rotator attachment. This permits the bins to remain at the vineyard where they can immediately be reused, thereby greatly increasing the efficiency with which the bins are used. The modification consists of permanently adding a receiver tube to the bin so that an elongated trunnion beam can be removably inserted through the receiver tube to a position at which end portions of the trunnion beam protrude beyond the ends of the receiver tube to serve as trunnions for use in lifting and rotating the harvest bin. The elongated trunnion beam can readily be removed when the bin is to be used in the conventional manner.

4 Claims, 4 Drawing Sheets

HARVEST BIN

BACKGROUND OF THE INVENTION

1. Field of the Invention

The present invention is in the field of receptacles, and more specifically relates to a bin used in the harvesting of grapes and other crops.

2. The Prior Art

In U.S. Pat. No. 2,971,662 issued Feb. 14, 1961 to Dunham, there is shown a U-shaped rotator attachment for a forklift that permits a bin to be lifted and rotated for the purpose of emptying the bin. In one embodiment, the rotator attachment engages a rectangular trunnion that extends outward from the side of the bin.

A comparable rotator attachment is shown in French Patent Publication No. 2,374,257 of Sortais, published Jul. 13, 1978.

In U.S. Pat. No. 2,860,797 issued Nov. 18, 1958 to Wilcox, there is shown a container that includes a reinforcing plate on opposite ends and in which two trunnions extend outward at each end from the reinforcing plates.

The bin of the present invention can be distinguished structurally from the bins shown in the above patents, and the structural differences greatly extend the usefulness of the bins.

SUMMARY OF THE INVENTION

The present invention is concerned with a special type of harvest bin that is widely used in California for harvesting grapes and other crops. It is sometimes referred to emptying the bin. At opposite ends of the lower edge of the inclined end wall, two hinge pins are provided, and the hinge pins extend parallel to the lower edge of the inclined end wall. The hinge bins are designed to engage cleats that extend along one side of a flatbed trailer to prevent the bin from slipping off the trailer when the bin is rotated upwardly about the hinge pins to empty the contents of the bin. This is the normal way in which the bins are emptied.

The present inventor noted that under some circumstances, which will be described below, it is desirable to be able to lift a bin and empty it by use of a forklift rotator attachment of the type shown in the patents referred to above. Unfortunately, as the bins currently exist, they include no trunnions that the forklift rotator attachment can engage for lifting and rotating the bin. As a result, the bins can only be emptied, as a practical matter, by tipping them up about the hinge pins that are located along the lower edge of the inclined end wall.

It is an objective of the present invention to provide a modification or improvement to the harvest bins to permit them to be lifted and rotated by a forklift rotator attachment so that the bins can be emptied into larger trucks or other vehicles.

A further objective is to provide the aforementioned modification without impairing the conventional mode of emptying the bins, namely, by tipping them up on one end.

In accordance with the present invention, an aperture is formed in each end of the bin. Then, at each end of the bin, a reinforcing plate having an aperture is affixed to the end of the bin with its aperture in registration with the aperture in the bin end. Next, an elongated receiver tube is inserted through the aperture at one end of the bin, across the space within the bin, and out through the aperture at the other end of the bin.

In accordance with the present invention, the receiver tube protrudes a short distance outward from each of the end walls. The receiver tube is then affixed to the reinforcing plates in this position. Affixing the receiver tube to the reinforcing plates adds strength and rigidity to the bin and also seals the bin at the apertures to prevent liquid from leaking out of the bin.

Installation of the receiver tube makes it possible to empty the bin by using a forklift having a rotator attachment to lift and to rotate the harvest bin. When this is to be done, an elongated trunnion beam is inserted into the receiver tube until it protrudes beyond the ends of the receiver tube. The trunnion beam is secured in this position within the receiver tube by a quick-release pin. The protruding end portions of the trunnion beam serve as trunnions for use by the rotator attachment in lifting and rotating the bin. Installation of the receiver tube does not interfere with conventional uses of the bin; it may still be emptied by tilting it up on one end.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

The significance of the present invention cannot be fully understood without some background discussion of the environment in which the invention is to be used.

In the following paragraphs it will be seen how a relatively minor mechanical improvement to a conventional harvest bin has resulted in a more efficient way of getting California's wine grapes from the vineyard (where they are grown) to the winery (where the grapes are processed into wine).

It is not unusual for a winery to use grapes that are grown in a vineyard located a hundred miles or more from the winery.

When the grapes have ripened and are ready to harvest, a harvest trailer is pulled by a tractor between the rows of vines. One or more removable harvest bins are carried onboard the harvest trailer, and the plucked bunches of grapes are laid into the harvest bin.

The type of bin most commonly used is called a Valley Bin; thousands of these bins are in use throughout California. Each bin is approximately 8 ft. long, 4 ft. wide and 4 ft. deep, and holds about 5,000 pounds of grapes. An unmodified Valley Bin is shown in FIGS. 1 and 2.

Figure 1:
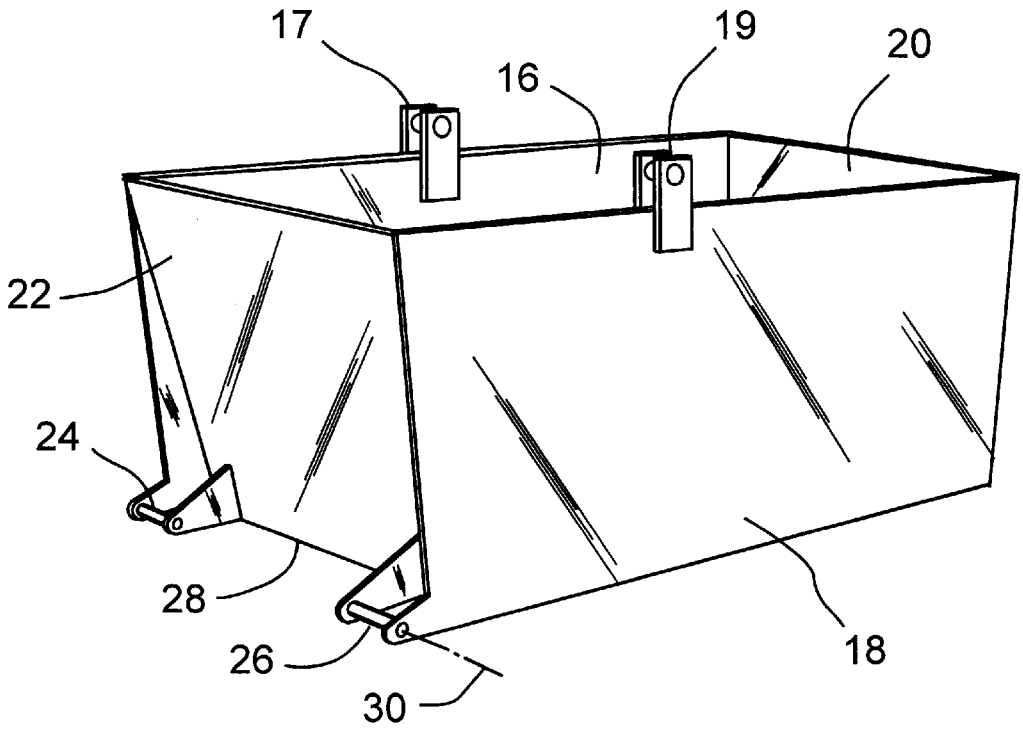
FIG. 1 (PRIOR ART)
FIG. 1 is a top side end perspective view of a harvest bin used in the prior art.
Figure 2:
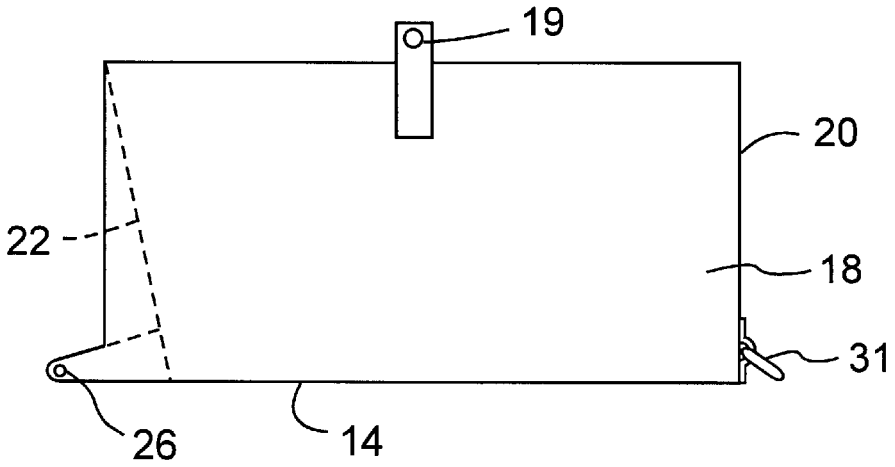
FIG. 2 (PRIOR ART)
FIG. 2 is a side elevational view of the prior art bin of FIG. 1.

As seen in FIGS. 1 and 2, the unmodified (prior art) bin includes a flat rectangular bottom 14 from which side walls 16 and 18 arise vertically. The end wall 20 also is perpendicular to the bottom 14, but the end wall 22 is inclined outward and upward from the bottom 14. Hinge pins 24 and 26 are provided adjacent the lower edge 28 of the end wall 22, and the hinge pins extend parallel to the edge 28.

When the bin is to be emptied, the hinge pins 24 and 26 are brought into engagement with cleats that prevent the bin from skidding when it is tilted upward about the axis 30 in a counterclockwise sense as viewed in FIGS. 1 and 2.

An overhead dump hook 29 is engaged to a lifing D-ring 31 located near the bottom of the end opposite the hinge pins 24, 26. The hook 29 is then raised by a hoist to tilt the bin up on end as shown in FIG. 4.

Figure 3:
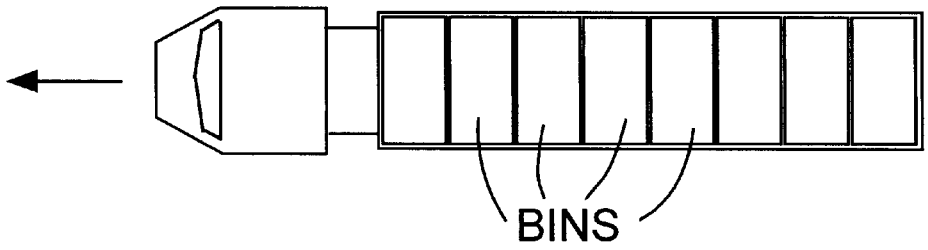
FIG. 3 (PRIOR ART)
FIG. 3 is a top plan view diagram showing prior art bins on a trailer.

The 8 foot length of the bin allows a number of the bins to be loaded side-by-side along the length of a flat-bed trailer without exceeding highway width limits. The filled harvest bins may be lifted onto a flat-bed trailer by the lifting ears 17 and 19. After the flat-bed trailer has been loaded, it is driven to the winery, perhaps one hundred miles away. FIG. 3 shows the bins on their way to the winery.

Figure 4:
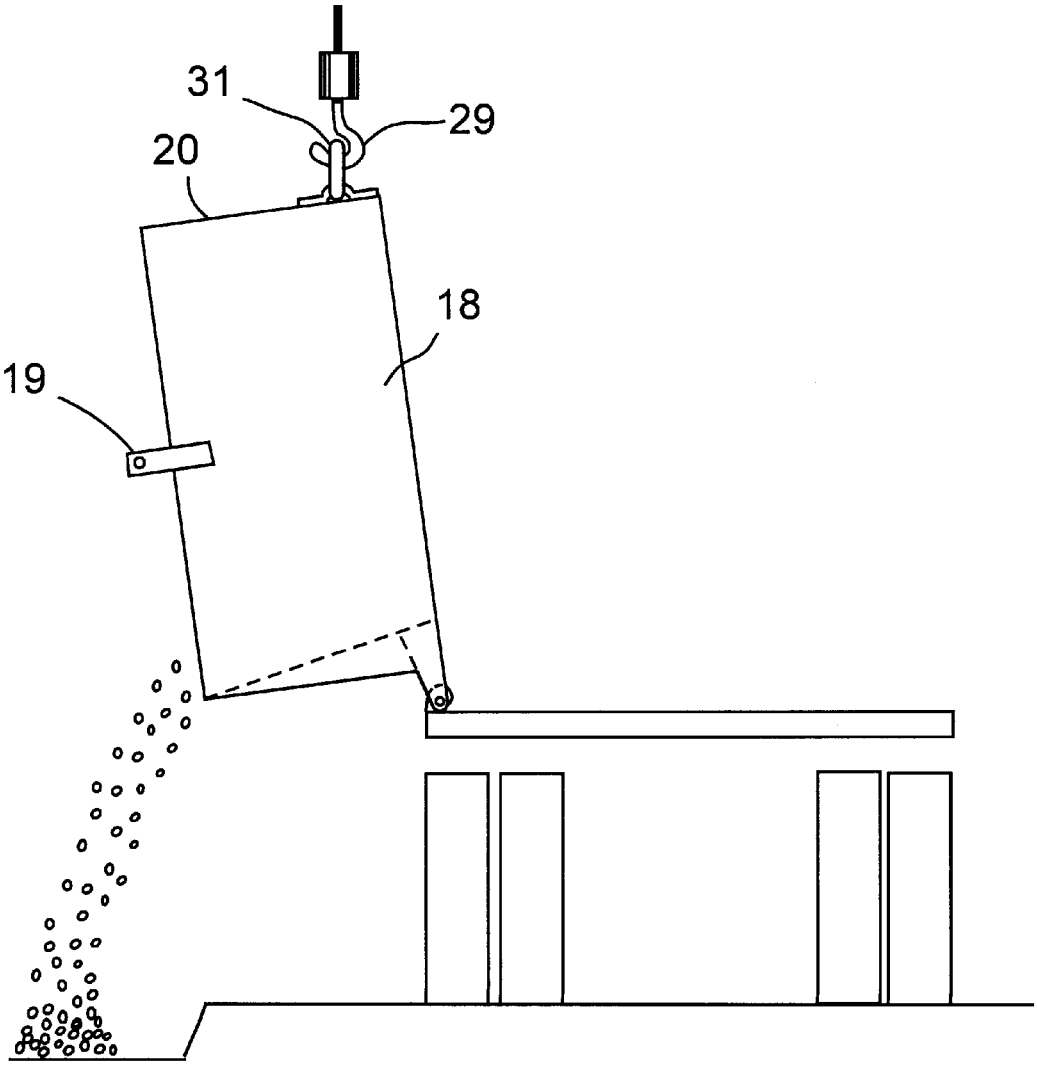
FIG. 4 (PRIOR ART)
FIG. 4 is an elevational view diagram showing a prior art bin being emptied from the bed of a trailer.

Upon reaching the winery, the bins are unloaded by tipping them up on end so that the grapes topple over the side of the trailer into a conveyor or auger at the winery, as shown in FIG. 4. The bins are not removed from the trailer.

After the grapes have been unloaded at the winery, the truck returns the bins to the vineyard, where the bins are transferred one-by-one to the harvest trailers or to a staging area.

The above discussion describes the conventional way in which the bins are used.

Time is of the essence in harvesting the grapes once they are ready. Waiting around for the bins to make a several-hour round trip to the winery is very undesirable. On the other hand, the bins are expensive and are used only at harvest time, so most growers have only a limited number of bins available. Thus, it is important that the bins be used as efficiently as possible.

The present inventor had long been aware of this problem, as had others in the industry. One day a solution to the problem occurred to him. The breakthrough was his realization that what really matters is getting the grapes to the winery, not getting the bins to the winery. The present inventor asked "Why not unload the bins into a dump truck at the vineyard, and send the dump truck to the winery, keeping the unloaded bins at the vineyard where they can be refilled by the time the dump truck gets back from the winery?"

There was only one problem with this idea. How to empty the fully-loaded 5,000 pound bins into a dump truck? Without modification the bin can only be emptied by tipping it up on end as shown in FIG. 4. An ordinary forklift has no provision for rotating the bins in the manner shown in FIG. 4.

Figure 5:
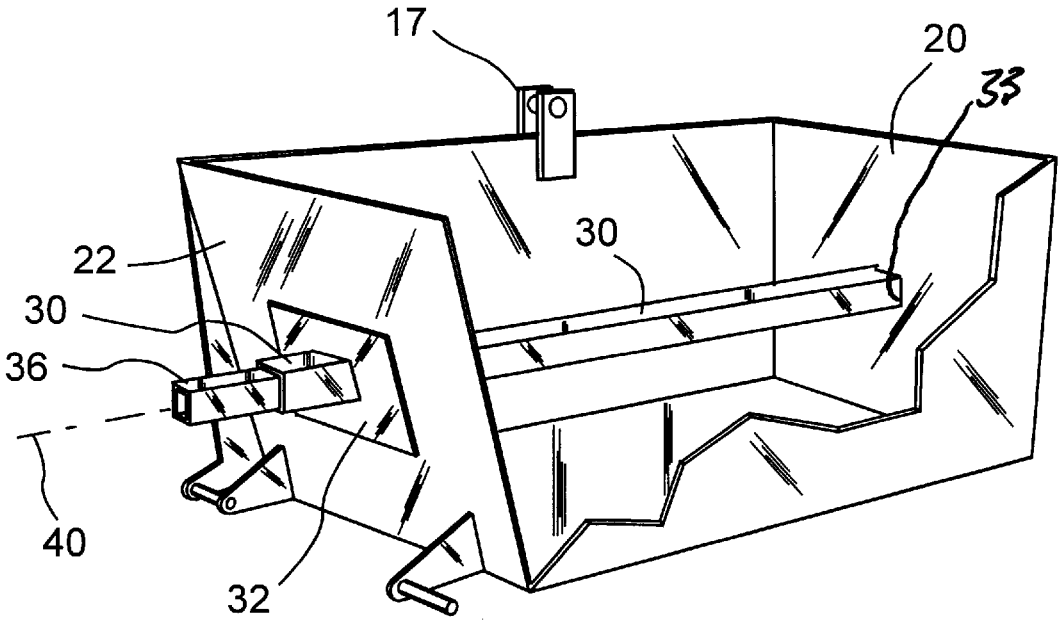
FIG. 5 is a top side end perspective view showing the bin of FIG. 1 with its front side wall removed to show the improvement of the present invention.
Figure 6:
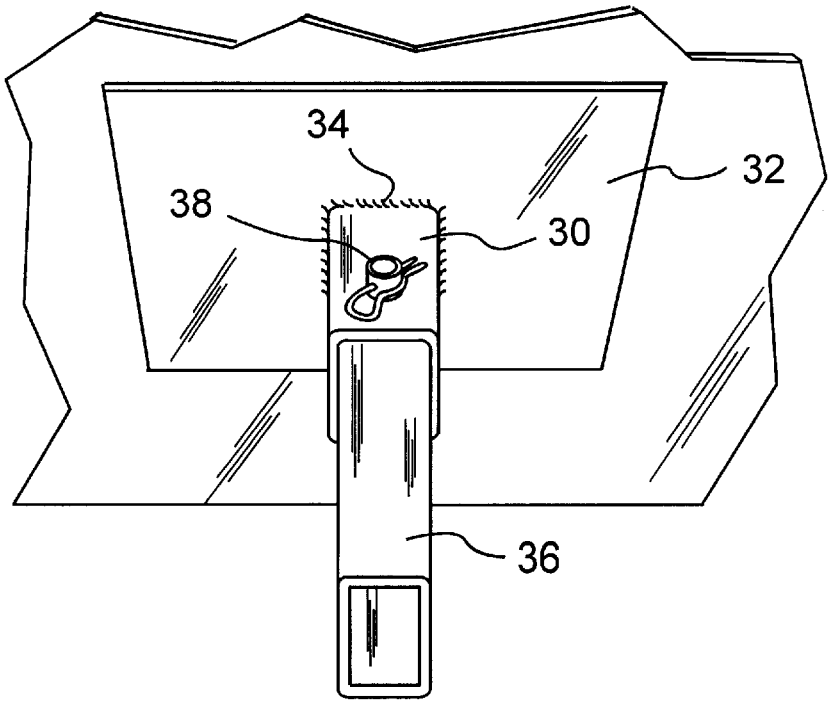
FIG. 6 is a top end perspective view showing the improvement of the present invention in greater detail; and, FIG. 7 is a top end perspective view showing the improvement of the present invention in use.

The present inventor solved this remaining problem by modifying the bin in the manner shown in FIGS. 5 and 6.

As seen in FIGS. 5 and 6, apertures, of which the aperture 33 is typical, are formed in the ends 20 and 22 of the bin. Reinforcing plates, of which the plate 32 is typical, having apertures of the same size as the aperture 33, are affixed to the ends 20, 22 with the apertures of the plates in registration with the apertures in the ends. Next, an elongated hollow receiver tube 30 is inserted through the apertures and positioned so that it extends outward from each end of the bin—protruding about 4 inches beyond the end 22 and about 0.25 inches beyond the end 20, in a preferred embodiment. The relatively short outward extension insures that the presence of the receiver tube does not interfere with the conventional uses of the bin, as described above, and that the overall width of the bin remains within highway width limits. The receiver tube is secured in this position by welding it to the reinforcing plates.

Because of their short length, the extending portions of the receiver tube cannot serve as trunnions for rotating the bin about the axis 40 of FIG. 5. Instead, removable trunnions are created by inserting an elongated trunnion beam 36 through the receiver tube 30. The elongated trunnion beam 36 protrudes outwardly far enough beyond the ends of the receiver tube to permit the protruding portions of the trunnion beam 36 to be utilized by a rotator attachment of a forklift for rotating the bin about the axis 40 to empty the bin into a dump truck. The elongated trunnion beam 36, like the receiver tube 30, must have an elongated cross section (as opposed to a circular cross section) so that the rotator attachment can maintain positive control of the angle of rotation. To avoid excessive weight, the elongated trunnion beam 36 preferably has a hollow cross section. After the elongated beam 36 has been inserted as described, it is secured in place by a quick-release pin 38 that also serves conveniently to index its axial location.

Thus it is seen that by modifying the bin by the addition of the receiver tube 30 and the reinforcing plates, the present inventor has enabled the use of removable trunnions which can be used when the harvest bin is to be emptied by rotating it about the axis 40. Further, because the elongated trunnion beam 36 may readily be removed, the modification of the bin does not interfere with the conventional manner of emptying it by rotating the bin about the axis 30 of FIG. 1.

Figure 7:
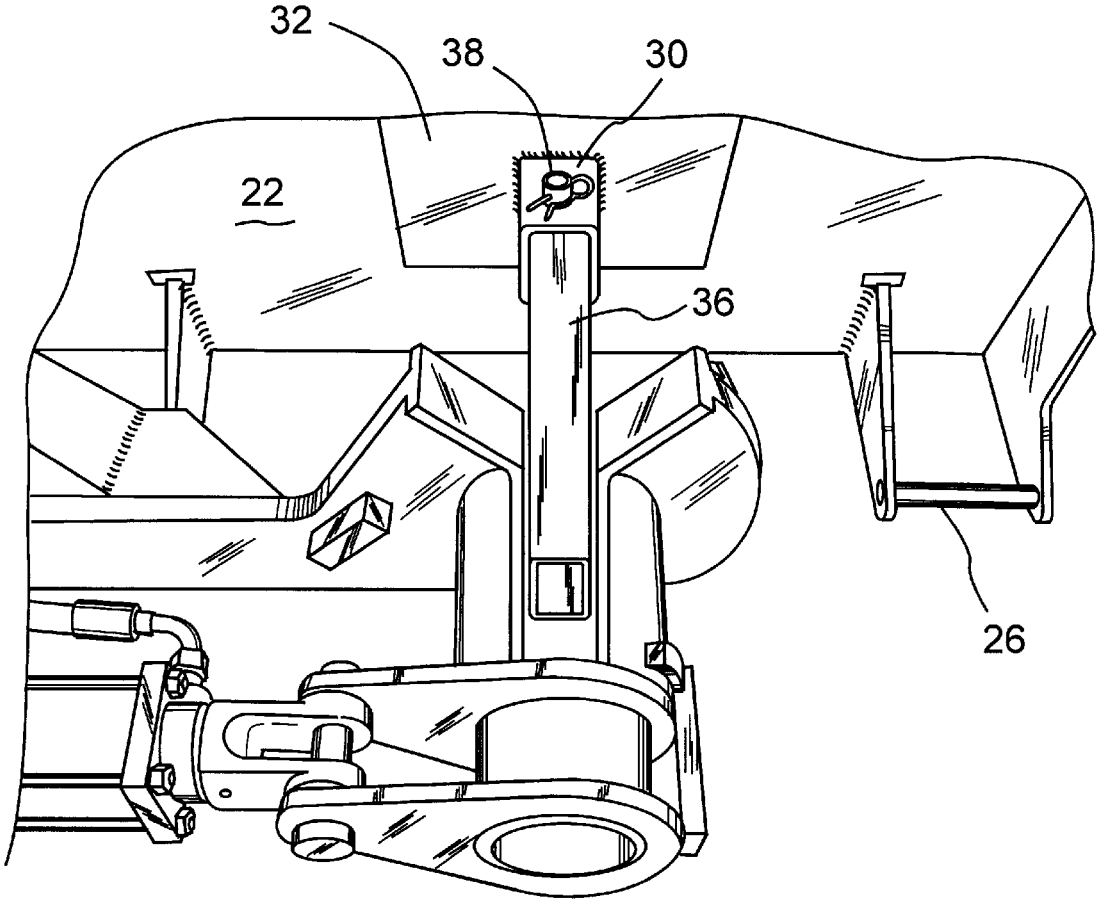

FIG. 7 shows the elongated trunnion beam 36 engaged by a rotator attachment of a type similar to that shown in U.S. Pat. No. 2,971,662 referred to above.

With the modified bin resting on a harvest trailer, a forklift that has been outfitted with a rotator attachment is maneuvered into a position from which the rotating mechanisms can be elevated to acquire the protruding portions of the elongated trunnion beam 36 and to lift the bin by raising the beam 36. Once free of the harvest trailer, the bin is carried by the forklift to a waiting dump truck. The bin is then raised to a height that clears the dump truck. Next, hydraulic power is applied to the rotating mechanism to rotate the bin approximately 170 degrees so that the grapes fall into the dump truck. The empty bin may then be returned by the forklift to the harvest trailer for immediate reuse, and the trunnion beam may be removed.

Thus, it is seen that by permitting the bins to be immediately reused, instead of being transported to and from a winery, the modification of the present invention results in a much more effective use of the bins. When the modification of the present invention is used, the bins never have to leave the vineyard.

Although the increase in efficiency in the use of the bins depends on the specific facts of a particular situation, it is not unusual to find that in a typical situation, a several hundred percent increase in the efficiency can be obtained.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A multi-function harvest bin for receiving picked crops, and for dumping said crops alternatively by being tilted around an axis fixed to a truck bed, or by being manipulated by a lifting and rotating device, said bin comprising:

a flat rectangular bottom having two side edges and having two end edges which are shorter than said side edges;

two side walls, each arising from a respective one of said two side edges;

a first and a second end wall, each arising from a respective one of said two end edges, a first end wall rising substantially vertically from said bottom, and said second end wall arising at an obtuse angle thereto, whereby the upper edge of said second end wall extends as an overhang past the respective end edge of said bottom to provide a slanted inside surface in the cavity formed by said walls, said cavity being open at the top, with a larger area at the open top than at the closed bottom, said walls being attached and fluid tight at their abutting edges;

a pair of aligned, spaced-apart hinge pins attached to said side walls and to said second end wall, spaced from said second end wall to enable grasping of the hinge pins by cleats to permit rotation of said bin around said hinge pins to dump contents of said bin;

a lift ring fixed to said first end wall to lift said first end wall and tilt said bin;

a rigid plate fixed to each of said end walls, each said plate having an aperture therethrough, said apertures being aligned on an axis parallel to said bottom;

a rigid axially straight tube rigidly fixed to both of said plates, said tube having an axial passage parallel to said bottom with an inside wall which is non-circular in cross-section; and a rigid rod having a non-circular outer surface which freely passes into said passage, but which interferes with said inside wall of said passage when rotated therein, whereby said bin can be translated by translation of said rod, and rotated by rotation of said rod, said rod being axially removable from said passage, said plate forming a fluid tight seal between said end walls and said tube.

2. Apparatus according to claim 1 in which said rod and said internal cross-section are rectangular.

3. Apparatus according to claim 1 in which said tube projects beyond each of said end walls.

4. Apparatus according to claim 3 in which said tube projects farther from said second end wall than from said first end wall.

* * * * *